US005661459A

United States Patent [19]

Belcher

[11] Patent Number: 5,661,459

[45] **Date of Patent: *Aug. 26, 1997**

[54] PROXIMITY MONITORING APPARATUS EMPLOYING ENCODED, SEQUENTIALLY GENERATED, MUTUALLY ORTHOGONALLY POLARIZED MAGNETIC FIELDS

[75] Inventor: Donald K. Belcher, West Melbourne, Fla.

[73] Assignee: Harris Corporation, Melbourne, Fla.

[ * ] Notice: The term of this patent shall not extend beyond the expiration date of Pat. No. 5,477,210.

[21] Appl. No.: 530,653

[22] Filed: Sep. 20, 1995

Related U.S. Application Data

[63] Continuation of Ser. No. 322,713, Oct. 12, 1994, Pat. No. 5,477,210, which is a continuation of Ser. No. 55,164, Apr. 30, 1993, abandoned.

[51] Int. Cl.[6] ..... G08B 23/00

[52] U.S. Cl. ..... 340/573; 340/572; 340/568; 340/531; 340/825.34; 324/207.26

[58] Field of Search ..... 340/573, 572, 340/539, 531, 825.34, 568; 324/207.26

[56] References Cited

U.S. PATENT DOCUMENTS

| | | | |
|---|---|---|---|
| 4,598,272 | 7/1986 | Cox | 340/573 |
| 4,777,478 | 10/1988 | Hirsch et al. | 340/573 |
| 5,086,290 | 2/1992 | Murray et al. | 340/539 |
| 5,155,442 | 10/1992 | Mercer | 340/620 |
| 5,477,210 | 12/1995 | Belcher | 340/573 |

*Primary Examiner*—Jeffery Hofsass
*Assistant Examiner*—Benjamin C. Lee
*Attorney, Agent, or Firm*—Charles E. Wands

[57] ABSTRACT

A proximity detector includes a low frequency magnetic field generator, located with an individual being monitored, the generator sequentially generating a plurality of encoded, time varying magnetic fields having mutually orthogonal polarizations. A magnetic field sensor unit is provided within a second device, carried by another individual. The magnetic field sensor unit is operative to detect encoded magnetic field energy associated with one or more of the magnetic fields generated by the magnetic field generator. Preferably, the magnetic field sensor unit includes a plurality of magnetic field sensors having respective magnetic field polarization sensitivities that are oriented mutually orthogonal with respect to one another. Each of the magnetic field sensors produces a respective first output signal in response to detecting encoded magnetic field energy generated by the magnetic field generator of at least a predefined level and containing an code pattern corresponding to that stored by the magnetic field sensor unit. A time-out circuit is coupled to each of the magnetic field sensors, and generates an alarm signal in response to a prescribed failure to receive a first output signal from any of the magnetic field sensors within periodic time intervals, thereby indicating that the monitored individual is beyond a prescribed range or distance from the monitoring individual.

31 Claims, 5 Drawing Sheets

PROXIMITY MONITORING APPARATUS EMPLOYING ENCODED, SEQUENTIALLY GENERATED, MUTUALLY ORTHOGONALLY POLARIZED MAGNETIC FIELDS

CROSS REFERENCE TO RELATED APPLICATIONS

This is a continuation application of application Ser. No. 08/322,713, filed Oct. 12, 1994, now U.S. Pat. No. 5,477,210, which is a continuation of No. 08/055,164, filed Apr. 30, 1993, abandoned.

The present invention relates to subject matter described in U.S. patent application Ser. No. 055,166, abandoned, entitled "Proximity Detector Employing Sequentially Generated, Mutually Orthogonally Polarized Magnetic Fields", filed Apr. 30, 1993, and the disclosure of which is herein incorporated.

FIELD OF THE INVENTION

The present invention relates in general to proximity monitoring systems and is particularly directed to a proximity detection system which employs encoded, sequentially generated and mutually orthogonally polarized magnetic fields to monitor the whereabouts of an object or individual, e.g. child.

BACKGROUND OF THE INVENTION

Proximity detection devices are used in a wide variety of applications for determining the relative nearness or separation of an object or person relative to another object or person. An application of such devices that has recently acquired considerable public interest involves using such devices to allow a responsible individual, such as parent or guardian, to monitor the whereabouts of another person in the custody of the responsible individual. One example of a monitoring system that is intended to equip a responsible individual with the ability to monitor the whereabouts of another person, such as a child, is described in the U.S. Pat. No. 4,598,272, to Cox, the disclosure of which is incorporated herein.

In accordance with the system described in the Cox patent, proximity monitoring is performed by equipping each of a parent and a child with a respective radio transmitter—radio receiver pair. The radio transmitter carried by the child is operative to broadcast or radiate a high frequency RF electromagnetic wave to which the receiver in the unit carried by the parent is tuned. Should the level of the received RF signal monitored by the parent's radio receiver drop below a prescribed threshold, indicating that the child has moved to location beyond a prescribed distance from the parent, an alarm signal is generated by the parent's device. In response to the alarm signal, the parent may then active his or her own radio transmitter, which broadcasts a radio wave that has substantial signal strength, so that it will be detected by the child's unit. When the child's unit detects the RF signal transmitted by the parent's unit, it outputs an audible alarm signal that is loud enough to be heard by the parent, thereby enabling the parent to locate the child.

Now although the signal strength-monitoring—alarm—response radio wave communication scheme employed in the system described in the Cox patent facilitates alerting a parent/guardian of the separation of a child, patient, etc. beyond a prescribed distance, it has been found that the use of a high frequency radio wave as the signalling mechanism has a number of inherent problems that limit its performance, and thereby prevent its practical application to a wide variety of signalling environments.

More particularly, a fundamental shortcoming of a high frequency radio wave (e.g. one on the order of 300+ MHz) is the fact that radio waves are subject to multipath propagation, which can be especially severe in the interior of a building. Secondly, colinearity between the direction of polarization of the broadcast RF signal and the receiver antenna is required for ensuring optimum signal reception. A further problem is the effect of the dielectric distortion effect of the human body (a substantial salt water mass) on the signal, which can typically causing a fluctuation in signal amplitude on the order of 10–15 dB. Moreover, since the signal strength of a radiated electromagnetic wave is inversely proportional to the square of the distance from the emitter, the setting of a signal strength threshold to trigger an alarm yields very imprecise results, especially when considering the other effects described above.

SUMMARY OF THE INVENTION

The above discussed problems of attempting to receive and accurately detect the signal strength of radiated high frequency (RF) electromagnetic energy in order to permit an individual (parent) to monitor the relative proximity of another object or person, such as a child, are effectively obviated by the magnetic field-based proximity system of the present invention, which is operative to generate a plurality of relatively low frequency magnetic fields having mutually orthogonal polarizations, that are not subject to multipath propagation, human body dielectric distortion, or threshold level imprecision. By relatively low frequency is meant time varying magnetic fields on the order of several tens to hundreds of kilohertz, having a standing wavelength (on the order of a mile or more) which is considerably greater than the maximum allowable operative range of separation between the monitoring and monitored individuals, which may typically be on the order of tens of feet. Each magnetic field is modulated by a prescribed encoding pattern, as by way of on-off keying of the respective magnetic field generators that produce the mutually orthogonal magnetic fields, so as to give the system a unique identity and permit multiple systems to be used in the same operating environment without mutual interference.

For this purpose, the novel magnetic field-based proximity detector according to the present invention includes a magnetic field generator which is provided within a first device, as may be carried by an object, animal or person (e.g. child), whose whereabouts is being monitored. The magnetic field generator sequentially generates a plurality of magnetic fields of respectively different magnetic field polarizations. In accordance with a preferred embodiment of the present invention, the magnetic field generator is operative to sequentially generate three time varying magnetic fields having respective field polarizations that are mutually orthogonal to one another, so that complete coverage, without nulls, is provided for a three dimensional space coordinate system. To accommodate the use of multiple systems within the same operating environment, each of the sequentially generated magnetic fields is encoded, in particular, subjected to an on-off keyed (amplitude) modulation pattern that is unique for a particular system.

A magnetic field sensor unit is provided within a second device, carried by another individual, such a parent or guardian, monitoring the whereabouts of the person, animal or object. The magnetic field sensor unit is operative to detect magnetic field energy associated with one or more of the encoded magnetic fields sequentially generated by the magnetic field generator carried by the monitored individual. The magnetic field sensor unit preferably includes a plurality (two or more) of magnetic field sensors having respective magnetic field polarization sensitivities that are oriented mutually orthogonal with respect to one another. The outputs of the magnetic field sensors are coupled to respective decoder circuits, which are operative to compare received sensor signals with a stored code pattern corresponding to that employed by the first device. Whenever the decoded contents of the received signals match the stored code, a "hit" is declared by the decoder circuit associated with each respective magnetic field polarization channel. The output from each decoder is coupled to a time-out circuit, which monitors the rate at which it is receiving 'hits' from the outputs of any of decoders. As long as a 'hit' is received from any decoder within a prescribed periodic time interval, a determination is made that the monitored object is within the proximity of the monitoring individual. However, if the monitored object goes out of range, none of the magnetic field sensors will detect sufficient energy to permit a code match 'hit' to be declared. When the time-out circuit receives no 'hit' within the required time interval, it generates a "lost child" output signal, so as to alert the monitoring individual of the fact that the monitored individual (child) is beyond a prescribed range or distance from the monitoring individual (parent).

Advantageously, because the variation of power density of a magnetic field with respect to distance has a very emphatic inverse proportionality characteristic (to the sixth power of distance), the slope of the magnetic field signal strength variation is extremely steep over the major portion of the working range of the receiver, thereby allowing an out-of-range threshold to be readily and accurately established. In addition, this magnetic field does not radiate as does a broadcast RF wave; therefore, the previously described problems of multipath propagation and human body dielectric distortion are non existent. Due to the long wavelength and penetrating nature of the magnetic field in a dielectric, the distortions are non-existent.

As an adjunct, the parent's unit may be provided with an auxiliary RF paging transmitter which, when keyed, transmits paging RF signals to the child's unit, so that the child's unit may emit an audible alarm tone, to facilitate locating the child. Similar to the magnetic field proximity detector, the paging signals are encoded, so that multiple devices may be used in a common operating environment without mutual interference.

DETAILED DESCRIPTION

As described briefly above, the present invention successfully addresses problems associated with the use of radiated high frequency (RF) electromagnetic energy to monitor the relative proximity between a monitoring individual (e.g. parent or guardian) and a monitored individual (e.g. child) or object, by employing a relatively low frequency magnetic field generator, which is operative to sequentially generate a plurality of encoded magnetic fields having mutually orthogonal polarizations, that are not subject to multipath propagation, human body dielectric distortion, or threshold level imprecision.

As pointed out above, by relatively low frequency is meant a time varying magnetic field frequency on the order of several tens to hundreds of kilohertz, which has a standing wavelength (on the order of a mile or more) that is considerably greater than the maximum allowable operative range of separation between the monitoring and monitored individuals, which may typically be on the order of tens of feet.

Figure 1:
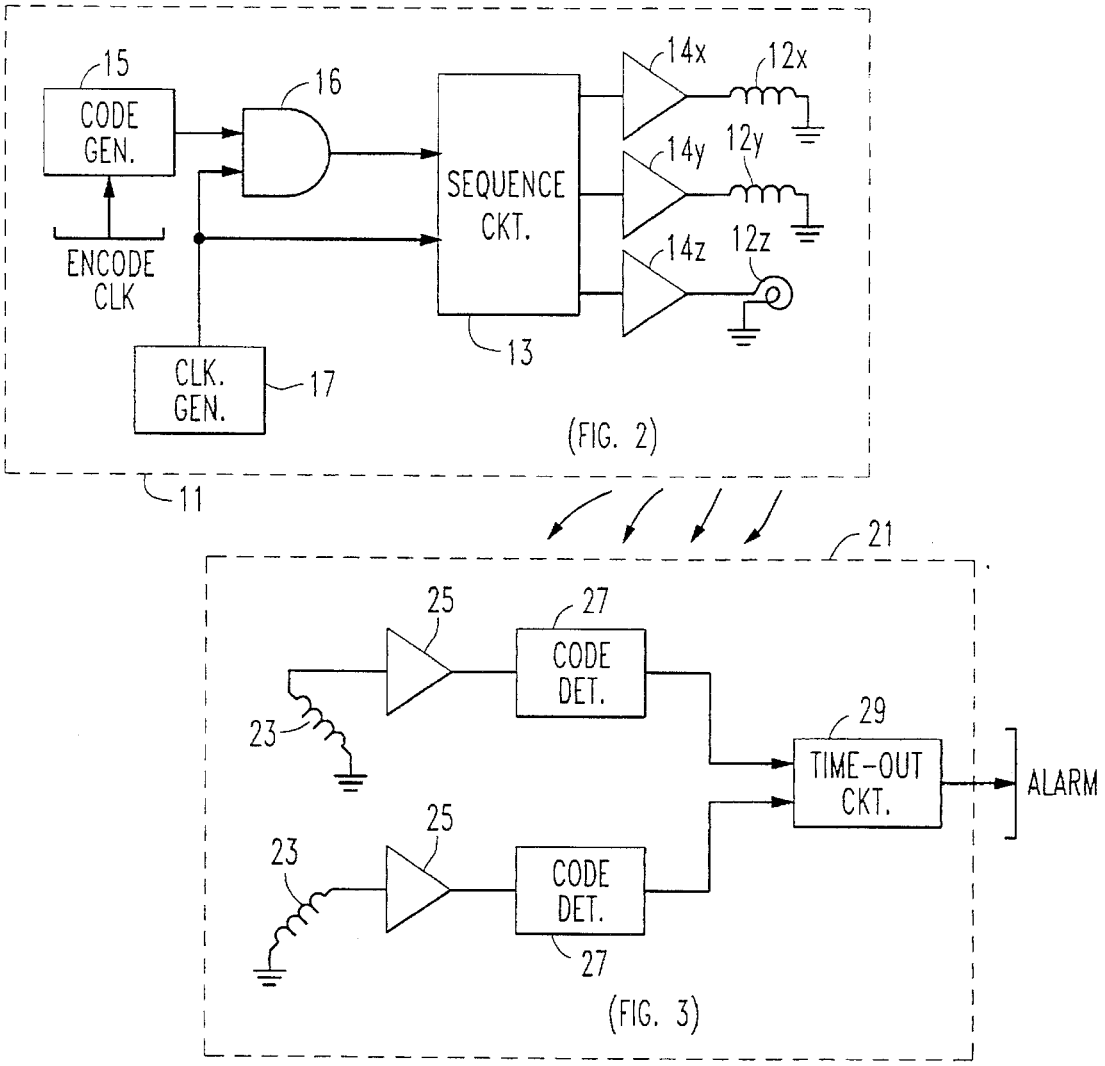
FIG. 1 is a diagrammatic illustration of an encoded multiple magnetic field proximity monitoring system in accordance with an embodiment of the present invention.

FIG. 1 is a diagrammatic illustration of an encoded multiple magnetic field proximity monitoring system in accordance with an embodiment of the present invention, and comprises a first device, such as a portable magnetic field generator unit 11, that is adapted to be carried by a person, animal or object whose whereabouts are to be monitored. Unit 11 is operative to sequentially generate a plurality of encoded, time varying magnetic fields of respectively different magnetic field polarizations. In accordance with a preferred embodiment of the present invention, magnetic field generating unit 11 sequentially generates three encoded, time varying magnetic fields having respective field polarizations that are mutually orthogonal to one another, so that complete coverage, without nulls, is provided for a three dimensional space coordinate system.

For this purpose magnetic field generating unit 11 may comprise three mutually orthogonal magnetic field generating coils, diagrammatically illustrated as coils 12*x*, 12*y* and 12*z*, which are sequentially energized by modulated signals supplied from the output of a sequencer unit 13 and amplified by respective amplifiers 14*x*, 14*y* and 14*z*, to produce three time varying magnetic fields having respective field polarizations, that are mutually orthogonal to one another. By generating three mutually orthogonal magnetic fields, it is assured that unit 11 will produce magnetic field flux lines in all dimensions of a three dimensional coordinate space around the unit 11, so as to effectively guarantee reception by a monitoring magnetic field sensor, regardless of its orientation (polarization sensitivity).

To accommodate the use of multiple systems within the same operating environment, each of the magnetic fields produced by magnetic field generating coils 12 is encoded with an encoding (e.g. amplitude modulation) pattern that is unique for a particular system. For this purpose, unit 11 includes a digital code generator 15, the details of which will be described below with reference to FIG. 2, digital code generator 15 generating a prescribed binary coded waveform in accordance with an encoding clock signal. The output of code generator 15 is supplied as a first input to an AND circuit 16 to a second input of which a prescribed magnetic field modulation frequency (e.g. on the order of 60 KHz) produced by a clock generator 17 is applied. AND circuit 16 effectively operates as a modulation mixer or multiplier, to produce an on-off keyed modulation (in accordance with the binary encoding pattern produced by code generator 15) of the output of clock generator 17. The modulated frequency output of clock generator 17 is applied to a sequencer circuit or commutating switch 13, which sequentially couples the (binary on-off keyed) modulated clock signal to each of coils 12*x*, 12*y*, 12*z* from which three mutually orthogonal magnetic fields are produced.

The proximity system further includes a magnetic field sensor unit 21 which is carried by the individual, such as a parent or guardian, for monitoring the proximity (distance or range) of the sensor unit from the person, animal or object carrying magnetic field generator unit 11. Magnetic field sensor unit 21 is operative, regardless of its orientation, to detect magnetic field energy associated with one or more of the magnetic fields generated by the coils 12 of magnetic field generator unit 11. For this purpose, magnetic field sensor unit 21 includes a plurality (e.g. two in the illustrated embodiment) of magnetic field sense coils 23, having respective magnetic field polarization sensitivities that are oriented mutually Orthogonal with respect to one another. (It is to be understood that more than two coils and associated downstream detection circuits, to be described, may be used in the sensor unit.)

Each of magnetic field sense coils 23 is coupled to a respective field strength measurement circuit 25, which is operative to produce a respective output signal in response to detecting magnetic field energy of at least a predefined level. The respective Outputs of field strength measurement circuits 25 are coupled to respective decoder circuits 27, which compare detected magnetic field signals with a stored code pattern corresponding to the code pattern employed by unit 11. Whenever the decoded contents of the received signals match the stored code, a 'hit' is declared by the decoder circuit associated with each magnetic polarization channel. The output from each decoder 27 is coupled to a time-out circuit 29, which monitors the rate at which it is receiving 'hits' from the outputs of any of decoders 27. As long as a 'hit' is received from any decoder within a prescribed periodic time interval, a determination is made that the monitored object is within the proximity of the monitoring individual. However, if the monitored object goes out of range, none of the magnetic field sensors will detect sufficient energy to permit a code match 'hit' to be declared. When the time-out circuit 29 receives no 'hit' within the required time interval, it generates a "lost child" alarm as an output signal, so as to alert the monitoring individual of the fact that the monitored individual (child) is beyond a prescribed range or distance from the monitoring individual (parent).

Figure 2:
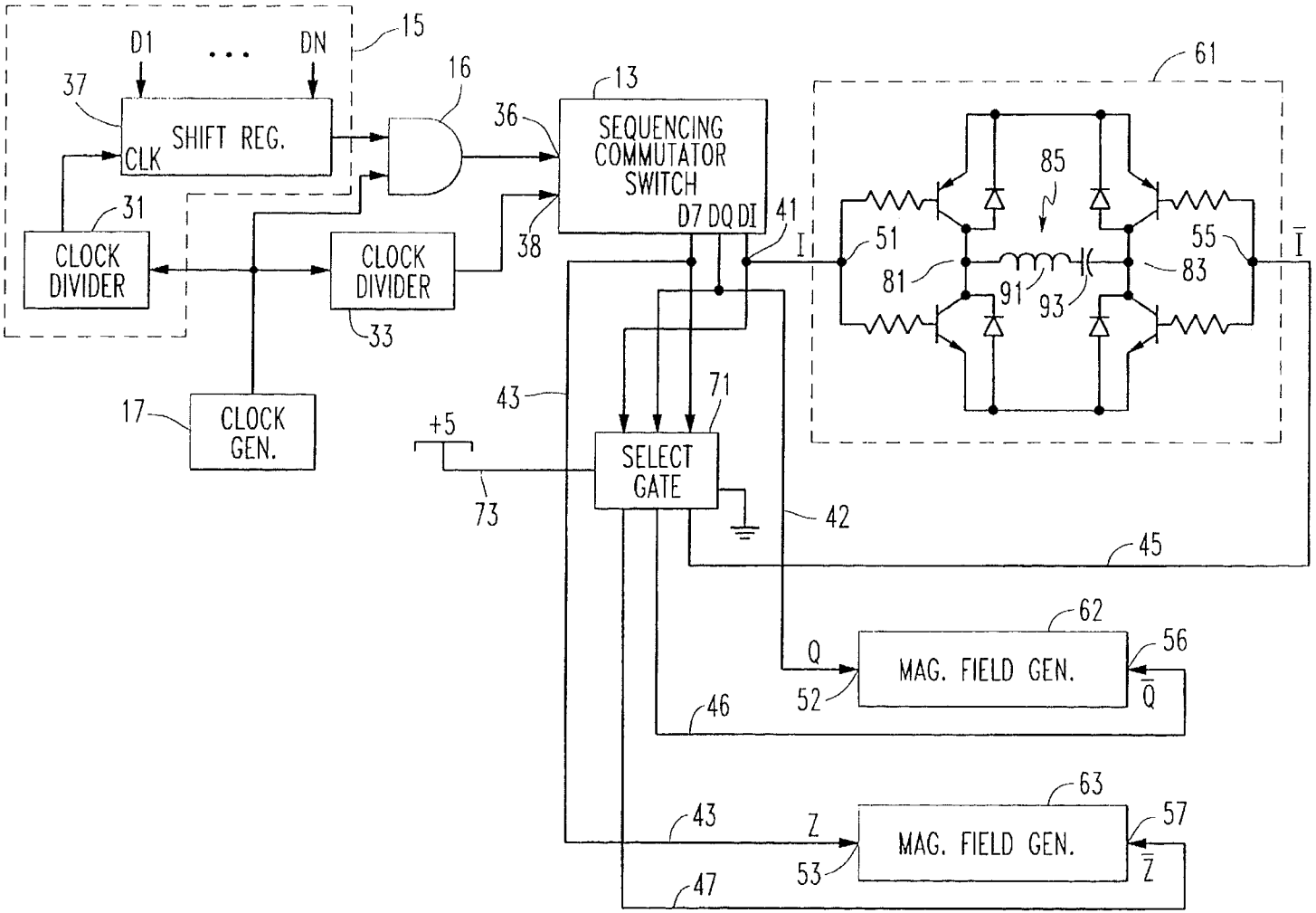
FIG. 2 is a detailed schematic diagram of the encoding magnetic field generator portion of the proximity monitoring system of FIG. 1.

The details of the magnetic field generator unit 11 of the proximity detection system of FIG. 1 are schematically illustrated in greater detail in FIG. 2 as comprising a reference clock or oscillator 17 having its output coupled to a first clock divider 31 which produces an encoding clock signal to be applied to code generator 15, and a second clock divider 33, produces a commutation control signal for controlling the operation of sequencer 13. Reference oscillator 17 generates a prescribed clock frequency, preferably on the order of several tens to several hundreds of kilohertz, as discussed above.

Digital code generator 15 comprises an N stage shift register 37, having a first, serial input stage coupled to the output of first clock divider 31. The number of (N) stages of which shift register 37 is comprised defines the length of the digital code word or encoding pattern used to modulate each of the magnetic field generating coils. The respective stages of shift register 37 are coupled to receive a set of parallel input binary code values D0 . . . DN that define the encoding pattern employed by the unit. Binary code values D0 . . . DN may be defined by a set of presetable switches (not shown), for example manually setable switches commonly employed in hand held utility devices, such as a garage door opener code transmitter unit. As shift register 37 is clocked by the output of clock divider 31 it produces a serial binary pattern of '1''s and '0''s that define the encoding sequence of the unit. This binary pattern may be considered to be a (binary) pulse width modulation signal. When this signal is combined with (effectively multiplied by) the output of oscillator 17 in AND circuit 16, what is produced is an on-off keyed clock signal.

This on-off keyed clock signal is applied to a first input 36 of sequencer (commutating switch) 13. Commutating switch 13 has a second input coupled to receive the output of second clock divider 33. Commutating switch 13 sequentially couples the on-off keyed modulation signal at its first input 36 produced as respective outputs (three in the illustrated example) 41, 42, 43 to non-inverted drive inputs 51, 52, 53 of respective magnetic field generator circuits 61, 62, 63 and to a select gate 71. Select gate 71 is operative to selectively switch a complementary voltage applied to input 73 to respective output lines 45, 46, 47 to inverting drive inputs 55, 56, 57 of the magnetic field generator circuits.

Each of the magnetic field generator circuits is identical, being configured in the manner shown in dotted lines 61 as comprising a pair of push pull bipolar transistor drivers 81, 83 coupled to opposite ends of a resonant or tank circuit 85, containing a magnetic field generating coil 91 and an associated capacitor 93. The respective coils 91 of magnetic field generator circuits 61, 62, 63 are physically oriented such their respective coil axes are arranged mutually orthogonal to one another. As a result, during successive repeated cycles of commutation switch 13, as the push-pull coil transistor driver pairs of the magnetic field generators 61, 62, 63 are successively driven by complementary drive signals at the modulated frequency output by AND circuit 16, their associated coils 91 will generate a set of (three) mutually orthogonally polarized magnetic fields, thereby ensuring that magnetic field flux lines will be established in all dimensions of a three dimensional coordinate space around the magnetic field generator unit, and effectively guarantee reception by a monitoring magnetic field sensor within range of the magnetic field generator, regardless of their mutual orientations (polarizations).

Figure 3:
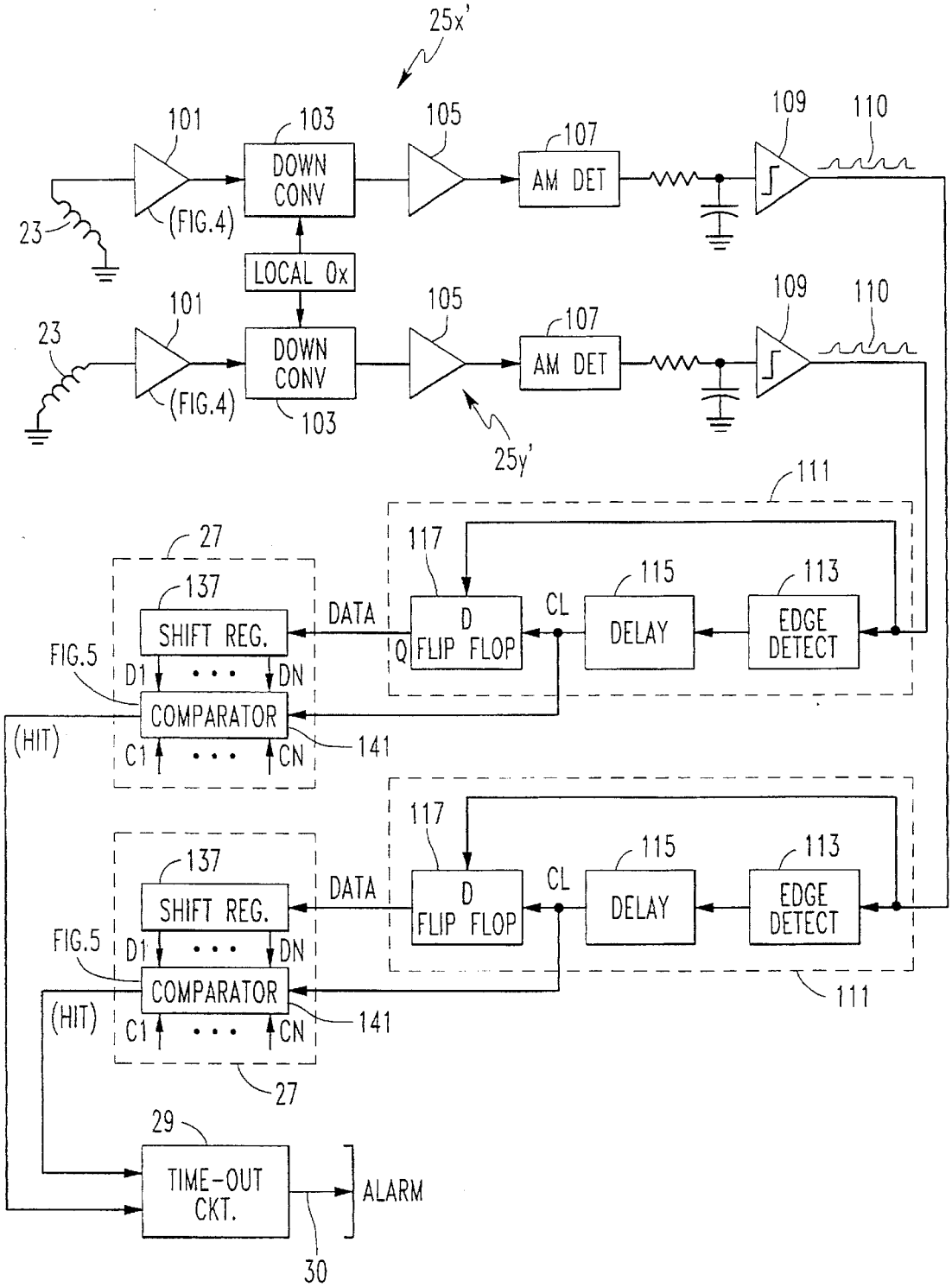
FIG. 3 is a diagram of the magnetic field sensor portion of the proximity detection system of FIG. 1.

FIG. 3 diagrammatically illustrates the details of the magnetic field sensor portion of the proximity detection system of FIG. 1 as comprising a plurality (e.g. two in the illustrated embodiment) of magnetic field sense coils 23*x'*, 23*y'*, having respective magnetic field polarization sensitivities that are oriented mutually orthogonal with respect to one another. Each of magnetic field sense coils 23*x'*, 23*y'* is coupled to a respective field strength measurement circuit 25, which is operative to produce a respective output signal in response to detecting magnetic field energy of at least a predefined level.

Figure 4:
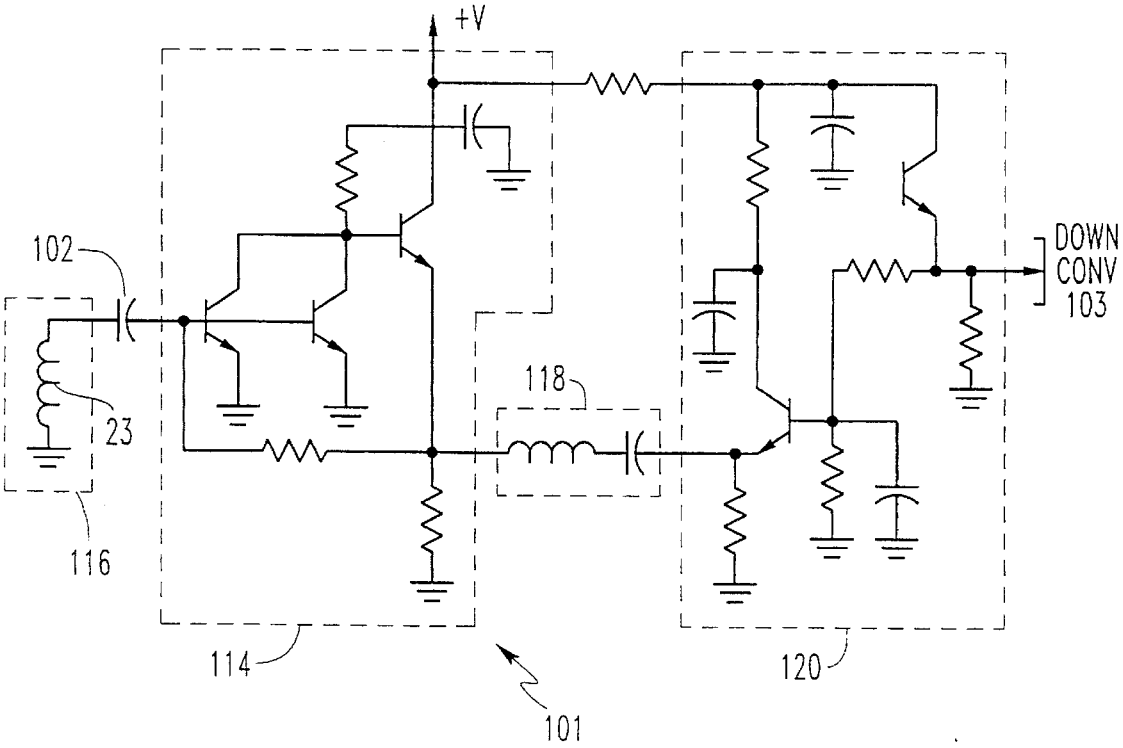
FIG. 4 is a detailed schematic diagram of the front end of a respective magnetic field sensor.

The magnetic field strength measurement circuit (25*x'*, 25*y'*) associated with each respective mutually orthogonal magnetic field channel (x', y') comprises a low noise magnetic preamplifier circuit 101, shown in detail in FIG. 4. More particularly, FIG. 4 shows the details of the front end of a respective magnetic field strength measurement circuit as comprising a magnetic field sense coil 23 (corresponding to one of coils 22*x'*, 23*y'*) and an associated capacitor 102, which form a resonant or tank circuit input to a first signal amplifier stage 114. Magnetic field sense coil 23 has a prescribed magnetic field polarization sensitivity that is oriented mutually orthogonal to those of the other coils of the magnetic field sensor unit. Magnetic field sense coil 23 may optionally be enclosed in an electric shield (Faraday screen) 116 to effectively shield the coil from electric fields. The output of amplifier stage 114 is coupled through a bandpass filter 118, which is tuned to the operating frequency of the system, to a second amplifier stage 120. The output of second amplifier stage 120 is coupled to down-converter 103 (FIG. 3). Successive amplifier stages 114, 120 provide a given amount of amplification of the monitored input signal (e.g. on the order of 30–40 dB), so as to obtain a prescribed overall signal gain (e.g. on the order of 60–80 dB).

Referring again to FIG. 3, the output of preamplifier circuit 101 is down-converted to a relatively low frequency (e.g. on the order of only a few KHz) by down-converter 103. The down-converted signal is then coupled through a low frequency amplifier 105 to an AM detector 107, such as a diode detector. The energy in the AM signal is integrated and applied to a hard-limiter 109, the output of which represents whether or not the amplified detected magnetic field energy in the channel of interest exceeds a prescribed threshold. The threshold of hard-limiter 109 is fixed, while the gain of preamplifier 101 is adjustable, so that the proximity sensitivity range (e.g. on the order of fifteen to thirty feet, as a non-limiting example) of the sensor is set in accordance with the gain adjustment of preamplifier 101.

The output of hard-limiter 109, shown as waveform 110, is applied to a pulse width modulation recovery circuit 111, which comprises an edge detector 113, delay circuit 115, and flip-flop 117, coupled in series, as shown, with flip-flop 117 having its data input "D" coupled to the output of hard-limiter 109. Edge detector 113 detects the positive-going edge of waveform 110, for the purposes of providing a recovered clock signal. This clock signal is then delayed by delay circuit 115 to position the clock in the center of a symbol time, for purposes of extracting the correct encoded value of the data. Delay circuit 115 and flip-flop 117 effectively form a long/short pulse detector which recovers the original data for application to downstream decoder 27.

Decoder 27 effectively complements the operation of the code generator contained in magnetic field generator unit 11, and comprises an N stage shift register 137, which is clocked by the clock output of delay circuit 115. The serial input of the first stage of shift register 137 is coupled to the output of flip-flop 117 of pulse width modulation recovery circuit 111. The number of stages of which shift register 137, corresponding to the length of the encoding pattern, is the same as that of shift register 37 of code generator 15. The respective stages of shift register 137 have their outputs coupled to a first set of compare inputs D1 . . . DN of a code comparator 141. Code comparator 141 has a second set of inputs coupled to receive a set of parallel input binary code values C0 . . . CN that define the encoding pattern employed by the magnetic field transmitter unit.

Figure 5:
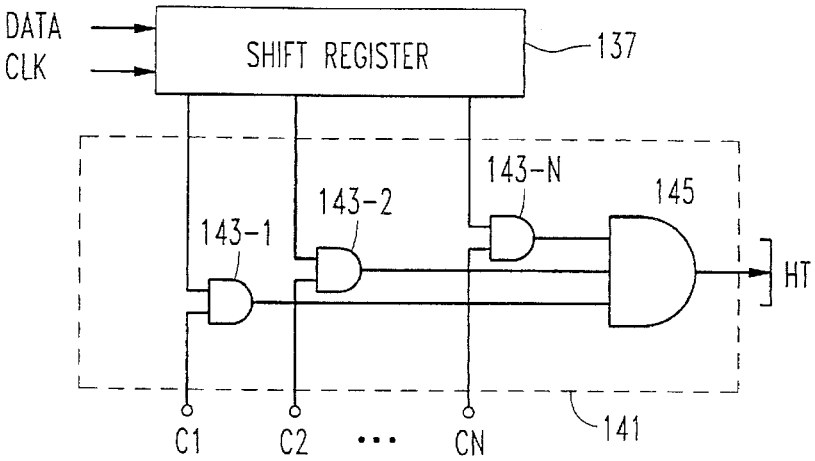
FIG. 5 is a logical diagram of a decoding comparator employed in the system shown in FIG. 3.

As shown in FIG. 5, code comparator 141 may comprise a set N of AND gates 143-0 . . . 143-N, each of which is coupled to receive a pair of inputs, respectively corresponding to one of the binary code values Ci and one of the shift register outputs Di. If the received code pattern is the same as that stored in the monitoring unit, then each of AND gates 143 will be a logical '1' and cause the output of an AND gate 145 to be a logical '1' representative of a 'hit'. Otherwise the output of AND gate 145 is a logical '0'.

The output from each decoder 27 is coupled to a time-out circuit 29, which monitors the rate at which it is receiving 'hits' from the outputs of any of decoders 27. As long as a 'hit' is received from any decoder within a prescribed periodic time interval (e.g. on the order of one to two seconds, for example), a determination is made that the monitored object is within the proximity of the monitoring individual. However, if the monitored object goes out of range, none of the magnetic field sensors will detect sufficient energy to permit a code match 'hit' to be declared. When the time-out circuit 29 receives no 'hit' within the required time interval, it generates a "lost child" alarm as an output signal on line 30. Line 30 is coupled to an indication device, such as a light emitting diode or other alarm indicating element or circuit (for example an audio alarm device), to provide a readily discernible indication of whether the monitored person or object is 'out of range'.

In operation, as long as the monitored individual (whose encoding pattern matches that stored in the monitoring unit) is within the sensitivity range of the monitoring unit, at least one of the decoders 27 will produce a 'hit' within the time-out interval. However, should the monitored individual go out of range, causing the magnitude of the sensed magnetic field energy (which, as noted previously, drops off very sharply in proportion to a sixth power of distance or separation), to decrease, the output of hard-limiter 109 will fall below threshold, so that no decoder 27 will produce a 'hit', triggering the output of alarm signalling device, and thereby indicating that the individual being monitored is beyond a prescribed range or distance from the monitoring site.

As pointed out above, as an adjunct to the multi-magnetic field proximity monitoring mechanism, described above, the magnetic field strength monitoring unit may be provided with a paging link. This paging link includes a radio transmitter provided in unit 21, which, when keyed, transmits RF paging signals to a receiver installed in the child's unit, so that the child's unit may emit an audible alarm tone, to facilitate locating the child. Such a paging link may be essentially the same as that described in the above referenced Cox patent, except that it also employs an encoder to prevent mutual interference among plural units in the same operating environment.

Figure 6:
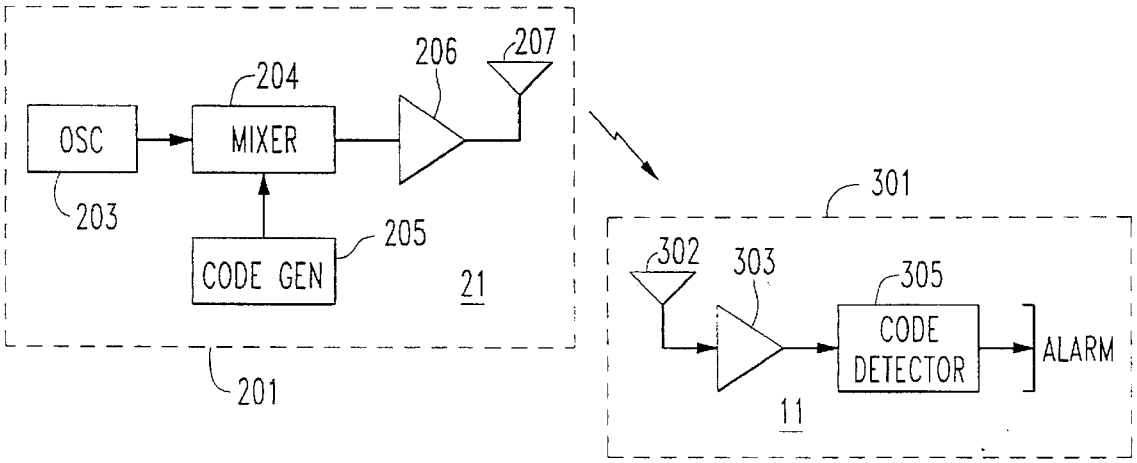
FIG. 6 shows an RF paging system adjunct to the system of FIG. 1.

The paging sub-system is diagrammatically illustrated in FIG. 6 as comprising a paging RF transmitter 201 having an oscillator 203 which is modulated in a mixer 204 by an encoding waveform, (preferably corresponding to that employed by the magnetic field proximity sensor unit) produced by code generator 205. The output of modulator 204 is applied to an RF amplifier 206 and transmitted via antenna 207. When the paging unit of FIG. 6 is keyed, it transmits an encoded RF paging signal to a receiver 301 the child's unit. Similar to the unit described in the Cox patent, the paging receiver includes an antenna 302, the output of which is coupled to an RF receiver 303. The encoded signal received from receiver 303 is decoded in an associated code detector 305 and coupled to an alarm device, such as a tone generator, so as to facilitate locating the child.

It should be observed that the broadcasting of an RF signal is suitable for paging purposes, since what is required of the paging receiver is that it simply needs to receive and respond to the page. It is not required to conduct proximity measurements on the basis of the monitored field strength of the RF signal, which, as noted previously, has been found to be an imprecise technique.

As will be appreciated from the foregoing description, the above discussed problems of receiving and accurately detecting the signal strength of radiated high frequency (RF) electromagnetic energy for the purpose of monitoring the relative proximity between two physically separated individuals are effectively eliminated in accordance with the relatively low frequency encoded magnetic field generator, sensing system of the present invention, which is operative to sequentially generate a plurality of encoded magnetic fields having mutually orthogonal polarizations, that are free from multipath propagation, human body dielectric distortion, or threshold level sensitivity imprecision.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed:

1. An arrangement for detecting whether a first entity is physically separated by more than a specified distance from a second entity comprising:

a magnetic field generator unit located at said first entity and being operative to generate a plurality of encoded, time varying magnetic fields; and a magnetic field detector unit which is located at said second entity and is operative to detect magnetic field energy associated with said time varying magnetic fields generated by said magnetic field generator unit, but, upon failing to detect a predefined threshold level of magnetic field energy, generates a first output signal representative that said first entity is physically separated by more than said specified distance from said second entity.

2. An arrangement according to claim 1, wherein said magnetic field generator unit is operative to generate a plurality of encoded, time varying magnetic fields having respectively different magnetic field polarizations.

3. An arrangement according to claim 2, wherein said magnetic field generator unit is operative to generate a plurality of encoded, time varying magnetic fields having magnetic field polarizations that are substantially mutually orthogonal to one another.

4. An arrangement according to claim 3, wherein said magnetic field generator unit is operative to generate respective ones of said plurality of encoded, time varying magnetic fields in sequence.

5. An arrangement according to claim 2, wherein said magnetic field detector unit comprises a plurality of magnetic field sensors having magnetic field polarization sensitivities that are oriented differently from one another, each of said magnetic field sensors being operative to produce a respective magnetic field detection signal in response to detecting a predefined level of magnetic energy.

6. An arrangement according to claim 5, wherein said magnetic field generator unit comprises a plurality of magnetic field generators which generate respective ones of said plurality of time varying magnetic fields in sequence.

7. An arrangement according to claim 1, wherein said magnetic field generator unit includes an encoder which is operative to generate said plurality of encoded time varying magnetic fields, and wherein said magnetic field detector unit includes a decoder which is operative to decode detected magnetic field energy that has been encoded by said encoder.

8. An arrangement according to claim 7, wherein said magnetic field generator unit is operative to sequentially generate a plurality of digitally encoded magnetic fields of respectively different magnetic field polarizations, each of said digitally encoded magnetic fields being digitally encoded with a prescribed multi-bit digital code pattern, and wherein said magnetic field detector unit is operative to detect magnetic field energy associated with one or more of the digitally encoded magnetic fields sequentially generated by said magnetic field generator and to produce a first output signal in response to detecting a predefined level of digitally encoded magnetic field energy generated by said magnetic field generator, and includes a digital decoding circuit, which is operative to compare digital code contents of said first output signal with a replica of said prescribed multi-bit digital code pattern and to generate a second output signal in response to the digital code contents of said first output signal containing said prescribed multi-bit digital code pattern.

9. An arrangement according to claim 8, wherein said magnetic field generator is operative to sequentially generate a plurality of digitally encoded magnetic fields having magnetic field polarizations that are substantially orthogonal to one another, and wherein said magnetic field detector unit includes a plurality of magnetic field detectors having respective magnetic field polarization sensitivities that are oriented differently from one another, and wherein each of said magnetic field detectors is operative to produce a respective first output signal in response to detecting a predefined level of digitally encoded magnetic energy generated by said magnetic field generator.

10. An arrangement according to claim 9, wherein said magnetic field detector unit is operative to produce a third output signal in response to said second output signal not being repeatedly produced within prescribed periodic time intervals.

11. An arrangement according to claim 9, wherein each of said magnetic field detectors is operative to produce a respective third output signal in response to failing to detect magnetic field energy generated by said magnetic field generator of at least said predefined level.

12. An arrangement according to claim 8, wherein said magnetic field generator is operative to generate a plurality of digitally encoded on-off keyed oscillating magnetic fields.

13. An arrangement according to claim 12, wherein said plurality of digitally encoded on-off keyed oscillating magnetic fields have a frequency in a range on the order of multiple tens to several hundred KHz.

14. A method for detecting whether a first entity is physically separated by more than a specified distance from a second entity comprising the steps of:

(a) generating a plurality of time varying magnetic fields from a first device located at said first entity; and (b) sensing, by way of a second device located at said second entity magnetic field energy associated with said time varying magnetic fields generated from said first device in step (a), but, in response to failing to detect a prescribed threshold level of magnetic field energy, providing a first output signal indicating that said first entity is physically separated by more than said specified distance from said second entity.

15. A method according to claim 14, wherein step (a) comprises generating a plurality of time varying magnetic fields, which have magnetic field polarizations that are substantially mutually orthogonal to one another.

16. A method according to claim 14, wherein step (a) comprises sequentially generating a plurality of encoded, time varying magnetic fields having respectively different magnetic field polarizations.

17. A method according to claim 16, wherein said second device includes a plurality of magnetic field sensors having magnetic field polarization sensitivities that are oriented differently from one another, and wherein step (b) comprises causing each of said magnetic field sensors to produce a respective magnetic field detection signal in response to detecting a predefined level of magnetic energy.

18. A method according to claim 14, wherein step (a) comprises generating respective ones said plurality of time varying magnetic fields in sequence.

19. A method according to claim 18, wherein step (a) comprises generating said plurality of time varying magnetic fields, such that said plurality of time varying magnetic fields have respectively different magnetic field polarizations.

20. A method according to claim 14, wherein step (a) comprises generating a plurality of encoded time varying magnetic fields, and step (b) comprises decoding detected magnetic field energy that has been encoded in step (a).

21. A method according to claim 20, wherein step (a) comprises sequentially generating a plurality of digitally encoded magnetic fields of respectively different magnetic field polarizations, each digitally encoded magnetic field being digitally encoded with a prescribed multi-bit digital code pattern, and step (b) comprises detecting magnetic field energy associated with one or more of said digitally encoded magnetic fields, and producing a first output signal in response to detecting a predefined level of digitally encoded magnetic field energy, comparing digital code contents of said first output signal with a replica of said prescribed multi-bit digital code pattern, generating a second output signal in response to the digital code contents of said first output signal containing said prescribed multi-bit digital code pattern, and issuing an alarm signal, representative that said first entity is physically separated by more than said specified distance from said second entity, in response to a failure of said second output signal to be produced at at least a prescribed periodic repetition rate.

22. A method according to claim 21, wherein step (b) further includes providing at said second entity an encoded radio wave transmitter, which is controllably operative to emit an encoded radio wave signal, and wherein step (a) comprises providing at said first entity an encoded radio wave receiver, which is operative to generate an humanly perceivable signal in response to detecting an encoded radio wave signal emitted by said encoded radio wave transmitter, and further including the step of:

(c) in response to the issuance of said alarm signal, causing said encoded radio wave transmitter at said second entity to emit said encoded radio wave signal, and thereby causing said encoded radio wave receiver at said first entity to generate said humanly perceivable signal in response to detecting said encoded radio wave signal emitted by said encoded radio wave transmitter.

23. A method for detecting whether a first entity has become separated entity by more than a specified distance from a second entity comprising the steps of:

(a) providing said first entity with a magnetic field generator unit which is operative to sequentially generate respective ones of a plurality of encoded, time varying magnetic fields; and (b) providing said second entity with a magnetic field detector unit which is operative to detect magnetic field energy associated with said encoded time varying magnetic fields sequentially generated by said magnetic field generator unit with which said first entity has been provided, said magnetic field detector unit being operative, upon failing to detect a predefined threshold level of magnetic field energy, to generate a first output signal representative that said second entity has become physically separated by more than said specified distance from said first entity.

24. A method according to claim 23, wherein said magnetic field generator unit is operative to generate a plurality of encoded, time varying magnetic fields, which have magnetic field polarizations that are substantially mutually orthogonal to one another.

25. A method according to claim 23, further including an encoded radio wave transmitter, which is located at said second entity and is controllably operative to emit an encoded radio wave, and further including an encoded radio wave receiver, which is located at said first entity and is operative to generate a humanly perceptible output in response to detecting an encoded radio wave signal emitted by said encoded radio wave transmitter at said second entity.

26. A method according to claim 23, wherein said magnetic field detector unit comprises a plurality of magnetic field sensors having magnetic field polarization sensitivities that are oriented differently from one another, each of said magnetic field sensors being operative to produce a respective magnetic field detection signal in response to detecting a predefined level of magnetic energy.

27. A method according to claim 26, wherein said magnetic field detector unit is operative to perform the steps of combining magnetic field detection signals generated by said plurality of magnetic field sensors and comparing the resultant combination of said magnetic field detection signals with a value representative of said predefined threshold level of magnetic field energy.

28. A method according to claim 27, wherein said value representative of said predefined threshold level of magnetic field energy is adjustable.

29. A method arrangement according to claim 23, wherein said magnetic field generator unit is operative to digitally encode sequentially generated magnetic fields with a prescribed multi-bit digital code pattern, and wherein said magnetic field detector unit is operative to detect magnetic field energy associated with digitally encoded magnetic fields sequentially generated by said magnetic field generator and to produce a first output signal in response to detecting a predefined level of digitally encoded magnetic field energy generated by said magnetic field generator, and includes a digital decoding circuit, which compares digital code contents of said first output signal with a replica of said prescribed multi-bit digital code pattern and to generate a second output signal in response to said first output signal matching containing said prescribed multi-bit digital code pattern.

30. A method according to claim 29, wherein said magnetic field detector unit is operative to produce a third output signal in response to said second output signal not being repeatedly produced within prescribed periodic time intervals.

31. A method according to claim 30, wherein each of said magnetic field detectors is operative to produce a respective third output signal in response to failing to detect magnetic field energy generated by said magnetic field generator of at least said predefined level.

* * * * *